US008427038B2

(12) United States Patent
Taido et al.

(10) Patent No.: US 8,427,038 B2
(45) Date of Patent: Apr. 23, 2013

(54) SPARK PLUG AND PROCESS FOR PRODUCING SAME

(75) Inventors: Akikazu Taido, Nagoya (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 195 days.

(21) Appl. No.: 13/058,472

(22) PCT Filed: Dec. 11, 2009

(86) PCT No.: PCT/JP2009/070723

§ 371 (c)(1),
(2), (4) Date: Feb. 10, 2011

(87) PCT Pub. No.: WO2010/087076

PCT Pub. Date: Aug. 5, 2010

(65) Prior Publication Data

US 2011/0148275 A1 Jun. 23, 2011

(30) Foreign Application Priority Data

Feb. 2, 2009 (JP) ..... 2009-021069

(51) Int. Cl.
*H01T 13/20* (2006.01)
*H01T 21/02* (2006.01)

(52) U.S. Cl.
USPC ..... 313/141; 313/143; 445/7

(58) Field of Classification Search ..... 313/118, 313/141–143; 445/7; 123/143, 169 R
See application file for complete search history.

(56) References Cited

U.S. PATENT DOCUMENTS

| | | | | |
|---|---|---|---|---|
| 5,494,706 | A | 2/1996 | Abe et al. | |
| 6,750,597 | B1 | 6/2004 | Sakura | |
| 2007/0236123 | A1 * | 10/2007 | Lykowski et al. | 313/141 |

FOREIGN PATENT DOCUMENTS

| | | | | |
|---|---|---|---|---|
| JP | 7-011409 | A | | 1/1995 |
| JP | 8-236263 | A | | 9/1996 |
| JP | 08236263 | A | * | 9/1996 |
| JP | 2001-068250 | A | | 3/2001 |
| JP | 2005-293954 | A | | 10/2005 |
| JP | 2005293954 | A | * | 10/2005 |
| JP | 2006-236906 | A | | 9/2006 |

OTHER PUBLICATIONS

"Road Vehicles-M12 × 1,25 Spark-Plugs with Flat Seating and 14 mm Bi-Hexagon and their Cylinder Head Housing", ISO 22977 First Edition, Jul. 15, 2005, International Standard.

* cited by examiner

*Primary Examiner* — Anh Mai
*Assistant Examiner* — Elmito Breval
(74) *Attorney, Agent, or Firm* — Sughrue Mion, PLLC

(57) ABSTRACT

There are provided a spark plug in which a plating film applied to a ground electrode can be relatively easily removed, without cost increase, to prevent deterioration in ignition performance, and a process for producing the spark plug. A spark plug 1 has a metal shell 3, a ground electrode 27 made of a Ni alloy and a Ni plating layer 28 containing Ni as a main component and applied to surfaces of at least a rear end portion of the ground electrode 27 and of the metal shell 3. A Ni plating film 41 applied to a center-electrode-side part of a portion of the ground electrode 27 to be bent has been irradiated with a laser beam or the like, thereby forming a molten layer 29 in which metal materials of the Ni plating film 41 and the ground electrode 27 are molten together on the center-electrode-side part of the portion of the ground electrode 27 to be bent. The Ni plating layer 28 is formed on a part of the ground electrode 27 other than the part irradiated with the laser beam.

8 Claims, 7 Drawing Sheets

(a)

(b)

(c)

SPARK PLUG AND PROCESS FOR PRODUCING SAME

TECHNICAL FIELD

The present invention relates to a spark plug for use in an internal combustion engine etc. and a production process thereof.

BACKGROUND ART

A spark plug for an internal combustion engine such as an automotive engine or the like includes, for example, a center electrode extending in an axis direction of the spark plug, an insulator located on an outer side of the center electrode, a cylindrical metal shell located on an outer side of the insulator and a ground electrode joined at a rear end portion thereof to a front end portion of the metal shell. The ground electrode is bent and arranged in such a manner that a front end portion of the ground electrode faces the center electrode, thereby defining a spark gap between the center electrode and the ground electrode.

In general, the metal shell is made of an iron-based material such as low-carbon steel and coated with a nickel plating layer for improvement in corrosion resistance. For the formation of the plating layer on the metal shell, a so-called barrel plating treatment can be advantageously used in terms of productivity improvement. Herein, the joining of the metal shell and the ground electrode is commonly done by resistance welding. It is thus difficult to join the ground electrode to the metal shell when the plating layer has been applied to the surface of the metal shell. Even if the ground electrode is joined to the metal shell, a breakage may occur in the plating layer at a welded joint between the metal shell and the ground electrode and become a cause of deterioration in corrosion resistance. It is accordingly common practice to perform a plating treatment on both of the metal shell and the ground electrode, after joining the metal shell and the ground electrode together, whereby a plating film is formed over the whole of surfaces of the metal shell and the ground electrode.

However, the bending of the ground electrode toward the center electrode, with the plating film being applied to the ground electrode, can lead to separation of the plating film. When the spark plug is used in such a state that the plating film is being separated from a center-electrode-side part of the ground electrode, a spark discharge (so called "side spark") between the separated part of the plating film and the center electrode may occur and cause deterioration in ignition performance.

It is conceivable to remove (peel off) the plating film, which has been applied to the whole surface of the ground electrode, from a given part of the ground electrode (for example, a portion of the ground electrode to be bent). There is proposed a technique of removing the plating film by immersing the given part of the ground electrode in an acidic remover while holding the metal shell with a predetermined jig. (See, for example, Patent Document 1.)

PRIOR ART DOCUMENTS

Patent Document

Patent Document 1: Japanese Laid-Open Patent Publication No. 2001-68250

SUMMARY OF THE INVENTION

Problems to be Solved by the Invention

However, the above proposed technique presents a problem of high production cost due to the need for handling and controlling the acidic remover and due to the wearing out of the jig by the acidic remover. There is also proposed a technique of avoiding the formation of the plating film on the given part of the ground electrode by performing the plating treatment after masking the given part of the ground electrode. Even in this proposed technique, there still remain concerns about problems such as cost increase and workability deterioration.

The present invention has been made in view of the above circumstances. It is an object of the present invention to provide a spark plug in which a plating film applied to a ground electrode can be relatively easily removed, without cost increase, so as to prevent deterioration in ignition performance. It is also an object of the present invention to provide a process for producing the spark plug.

Means for Solving the Problems

Various configurations suitable for solving the above problems and achieving the objects of the present invention will be described below under the following headings. The specific functions and effects of these configurations will be also described as needed.

Configuration 1: A spark plug, comprising: a rod-shaped center electrode extending in an axis direction of the spark plug; a cylindrical insulator having an axial hole formed therein in the axis direction and retaining the center electrode in the axial hole; a cylindrical metal shell disposed on an outer circumference of the insulator; and a ground electrode made of a nickel-based alloy, extending from a front end portion of the metal shell and bent at a substantially middle portion thereof in such a manner as to define a spark gap between a front end portion of the ground electrode and a front end portion of the center electrode, wherein the spark plug further comprises: a molten layer in which a metal material of a nickel-based plating layer applied to at least a center-electrode-side part of the portion of the ground electrode to be bent and a metal material of the ground electrode are molten together by irradiation with a laser beam or electron beam on the center-electrode-side part of the portion of the ground electrode to be bent; and a nickel-based plating layer on a part of the ground electrode other than the part irradiated with the laser beam or electron beam.

A noble metal tip of noble metal alloy may be disposed on the front end portion of the center electrode. In this case, the spark gap is defined between the noble metal tip and the ground electrode.

In Configuration 1, the molten layer in which the metal material (nickel alloy) of the ground electrode and the metal material of the plating film are molten together is formed by irradiation of the laser beam or electron beam on at least the center-electrode-side part of the portion of the ground electrode to be bent. Namely, the irradiation of the laser beam or electron beam enables removal of the plating film that has relatively poor adhesion to the ground electrode, and at the same time, formation of the molten layer on the surface of the ground electrode. This molten layer, in which the Ni alloy of the ground electrode and the Ni component of the plating film are molten together, has relatively good adhesion to the ground electrode. As the plating film has been removed from the portion of the ground electrode to be bent, no separation of the plating film occurs during the bending of the ground electrode. Further, almost no separation of the molten layer occurs during the bending of the ground electrode as the molten layer has good adhesion to the ground electrode. It is therefore possible to limit the occurrence of an abnormal spark discharge between the center electrode and the ground electrode and prevent deterioration in the ignition performance of the spark plug more assuredly.

In addition, in Configuration 1, the plating film is removed by irradiation of the laser beam or electrode beam. It is thus possible to obtain substantial cost decrease and dramatic workability improvement, as compared to the prior art technique of removing the plating film by immersing the front end portion of the ground electrode in the acidic remover and to the prior art technique of forming the plating film after applying the masking treatment to the ground electrode.

Configuration 2: The spark plug according to Configuration 1, wherein the nickel-based plating film has been applied to a part of the front end portion of the ground electrode defining the spark gap with the center electrode and been irradiated with the laser beam or electron beam so that the molten layer in which the metal material of the nickel-based plating film and the metal material of the ground electrode are molten together is formed on the part of the front end portion of the ground electrode defining the spark gap with the center electrode; and wherein the spark plug further comprises a noble metal tip joined to the molten layer.

The noble metal tip of noble metal alloy can be joined to the ground electrode for improvements in durability and ignition performance. However, it may be difficult to join the noble metal tip securely by resistance welding to the ground electrode when the plating film has been applied to the part (joint part) of the ground electrode to which the noble metal tip is joined.

In Configuration 2, the molten layer is formed by irradiation of the laser beam or electron beam onto the nickel-based plating film on the joint part of the ground electrode to which the noble metal tip is joined. The noble metal tip is thus joined to the ground electrode through the molten layer that has good adhesion to the ground electrode. This enables secure joining of the noble metal tip. Namely, it is possible that to attain secure welding resistance joint of the noble metal tip and the ground electrode relatively easily by irradiation of the laser beam or electron beam.

The molten layer formed by irradiation of the laser beam or electron beam has a fine surface roughness, which provides a significant effect in joining the noble metal tip to the ground electrode as in Configuration 2. The formation of the molten layer with such a surface roughness by irradiation of the laser beam or electron beam enables reduction in contact area between the noble metal tip and the molten layer, and by extension, increase in contact resistance between the noble metal tip and the molten layer during the resistance welding. It is thus possible to join the noble metal tip with sufficient strength even in the case where the pressure for pressing the noble metal tip against the ground electrode, or the welding current applied, is decreased to a relatively small level.

Configuration 3: The spark plug according to Configuration 1 or 2, wherein the nickel-based alloy of the ground electrode contains chromium; and the nickel-based plating layer contains 3 to 30 mass % of chromium.

For improvement in oxidation resistance, chromium (Cr) can be added to the ground electrode. However, the addition of Cr to the ground electrode makes it likely that Cr will diffuse (migrate) from the ground electrode into the Ni-based plating layer under high temperature conditions. This may result in the growth of Ni particles with the diffusion of Cr and fail to exhibit a sufficient oxidation resistance improvement effect.

In Configuration 3, the plating layer has a Cr content of 3 to 30 mass % so as to effectively limit the diffusion of Cr from the ground electrode to the plating layer even under high temperature conditions. It is thus possible to prevent the growth of Ni particles and exert a sufficient oxidation resistance improvement effect.

If the Cr content of the plating layer is less than 3 mass %, the diffusion of Cr from the ground electrode may not be limited properly. If the Cr content of the plating layer exceeds 30 mass %, the adhesion of the plating layer to the ground electrode may deteriorate so that the plating layer (plating film) becomes more susceptible to separation from the ground electrode. In the occurrence of separation of the plating layer, it is likely that the spark plug will generate an abnormal discharge (called "side spark") between the separated plating layer and the center electrode and deteriorate in ignition performance.

Configuration 4: A spark plug, comprising: a rod-shaped center electrode extending in an axis direction of the spark plug; a cylindrical insulator having an axial hole formed therein in the axis direction and retaining the center electrode in the axial hole; a cylindrical metal shell disposed on an outer circumference of the insulator; and a ground electrode made of a nickel-based alloy containing chromium, extending from a front end portion of the metal shell and bent at a substantially middle portion thereof in such a manner as to define a spark gap between a front end portion of the ground electrode and a front end portion of the center electrode, wherein the spark plug further comprises: a molten layer in which a metal material of a double coating of a nickel-based plating film and a chromate film applied to at least a center-electrode-side part of the portion of the ground electrode to be bent and a metal material of the ground electrode are molten together by irradiation with a laser beam or electron beam on the center-electrode-side part of the portion of the ground electrode to be bent; a nickel-based plating layer on a part of the ground electrode other than the part irradiated with the laser beam or electron beam; and a chromate film layer on the nickel-based plating layer.

In Configuration 4, the Ni-based plating layer and the chromate film layer are formed in this order on the part of the ground electrode other than the part irradiated with the laser beam or electron beam. This allows the diffusion of Cr from the part of which the surface is more susceptible to temperature increase than the inside of the ground electrode, i.e., from the chromate film layer on the surface of the ground electrode to the Ni-based plating layer, prior to the diffusion of Cr from the ground electrode to the Ni-based plating layer. It is thus possible to prevent the diffusion of Cr from the ground electrode to the plating layer more assuredly and improve the oxidization resistance of the ground electrode sufficiently.

As the influence of the Cr diffusion increases with the Cr content of the ground electrode, Configurations 3 and 4 are effective to the ground electrode of high Cr content. It is particularly preferable to apply Configurations 3 and 4 when the ground electrode has a Cr content of 10 mass % or higher, more preferably 20 mass % or higher.

Configuration 5: The spark plug according to Configuration 4, wherein the double coating of the nickel-based plating film and the chromate film has been applied to a part of the front end portion of the ground electrode defining the spark gap with the center electrode and been irradiated with the laser beam or electron beam so that the molten layer in which the metal material of the double coating and the metal material of the ground electrode are molten together is formed on the part of the front end portion of the ground electrode defining the spark gap with the center electrode; and wherein the spark plug further comprises a noble metal tip joined to the molten layer.

It is possible in Configuration 5 to obtain the same functions and effects as those in Configuration 2.

Configuration 6: The spark plug according to any one of Configurations 1 to 5, wherein a maximum length between a point of a surface of the plating layer closest to the molten layer and a point of the molten layer opposite from the surface of the plating layer in a thickness direction of the ground electrode is 200 μm or smaller.

In Configuration 6, the maximum length between the point of the surface of the plating layer closest to the molten layer and the point of the molten layer opposite from the surface of the plating layer in the thickness direction of the ground electrode (hereinafter referred to as "the apparent molten layer thickness") is controlled to a relatively small thickness of 200 μm or smaller. The adhesion of the molten layer to the ground electrode can be thus more assuredly prevented from deterioration. Further, the noble metal tip can be more assuredly joined to not only the molten layer but also the ground electrode when the apparent molten layer thickness is controlled to 200 μm or smaller. As a result, it is possible to join the noble metal tip with higher joint strength and prevent separation of the noble metal tip effectively.

Configuration 7: A production process of a spark plug, the spark plug comprising: a rod-shaped center electrode extending in an axis direction of the spark plug; a cylindrical insulator having an axial hole formed therein in the axis direction and retaining the center electrode in the axial hole; a cylindrical metal shell disposed on an outer circumference of the insulator; a ground electrode made of a nickel-based alloy, extending from a front end portion of the metal shell and bent at a substantially middle portion thereof in such a manner as to define a spark gap between a front end portion of the ground electrode and a front end portion of the center electrode; and a nickel-based plating layer formed on parts of surfaces of the ground electrode and the metal shell, the production process comprising: a plating film application step for performing a nickel plating treatment on the metal shell to which the ground electrode has been joined, thereby applying a plating film to substantially the whole of the surfaces of the metal shell and the ground electrode; a molten layer formation step for forming a molten layer in which metal materials of the plating film and the ground electrode are molten together by irradiation of a laser beam or electron beam onto at least a center-electrode-side part of the portion of the ground electrode to be bent; and a spark gap defining step for bending the portion of the ground electrode to be bent to define the spark gap between the front end portion of the ground electrode and the front end portion of the center electrode, wherein, in the molten layer formation step, the laser beam or electron beam is irradiated in such a manner that a maximum length between a point of a surface of the plating layer closest to the molten layer and a point of the molten layer opposite from the surface of the plating layer in a thickness direction of the ground electrode is larger than or equal to a thickness of the plating layer.

In Configuration 7, the molten layer formation step is performed by irradiating the laser beam or electron beam in such a manner that the maximum length between the point of the surface of the plating layer closest to the molten layer and the point of the molten layer opposite from the surface of the plating layer in the thickness direction of the ground electrode is larger than or equal to the thickness of the plating layer. This ensures formation of the molten layer in which the metal material of the plating film and the metal material (Ni alloy) of the ground electrode are molten together. It is thus possible in Configuration 7 to obtain the same functions and effects as those in Configuration 1.

Configuration 8: The production process of the spark plug according to Configuration 7, wherein the spark plug further comprises a noble metal tip disposed on the front end portion of the ground electrode so as to define the spark gap between the noble metal tip and the center electrode; wherein, in the molten layer formation step, the molten layer is formed by irradiation of the laser beam or electron beam on a joint part of the ground electrode to which the noble metal tip is joined; and wherein the production process further comprises joining the noble metal tip to the molten layer on the joint part of the ground electrode.

It is possible in Configuration 8 to obtain the same functions and effects as those in Configuration 2.

Configuration 9: The production process of the spark plug according to Configuration 7 or 8, wherein, in the molten layer formation step, the laser beam or electron beam is irradiated in such a manner that the maximum length between the point of the surface of the plating layer closest to the molten layer and the point of the molten layer opposite from the surface of the plating layer in the thickness direction of the ground electrode is 200 μm or smaller.

It is possible in Configuration 9 to obtain the same functions and effects as those in Configuration 6.

Configuration 10: The production process of the spark plug according to any one of Configurations 7 to 9, wherein, in the molten layer formation step, the laser beam or electron beam is irradiated in an atmosphere of an oxygen partial pressure of $10^3$ Pa or lower.

In Configuration 10, the laser beam or electron beam is irradiated in the atmosphere of an oxygen partial pressure of $10^3$ Pa or lower. It is thus possible to prevent oxidation of the formed molten layer effectively and secure improvement in durability.

Herein, the irradiation of the laser beam or electron beam in the atmosphere of an oxygen partial pressure of $10^3$ Pa or lower can be performed by various techniques, for example, irradiating the laser beam or electron beam in a vacuum, or irradiating the laser beam or electron beam while blowing an assist gas such as nitrogen, helium or argon onto the work surface.

BRIEF DESCRIPTION OF DRAWINGS

FIG. 4(*d*) is an enlarged section view showing a state of joint of a noble metal tip to the ground electrode according to the first embodiment of the present invention.

BEST MODES FOR CARRYING OUT THE INVENTION

[First Embodiment]

Figure 1:
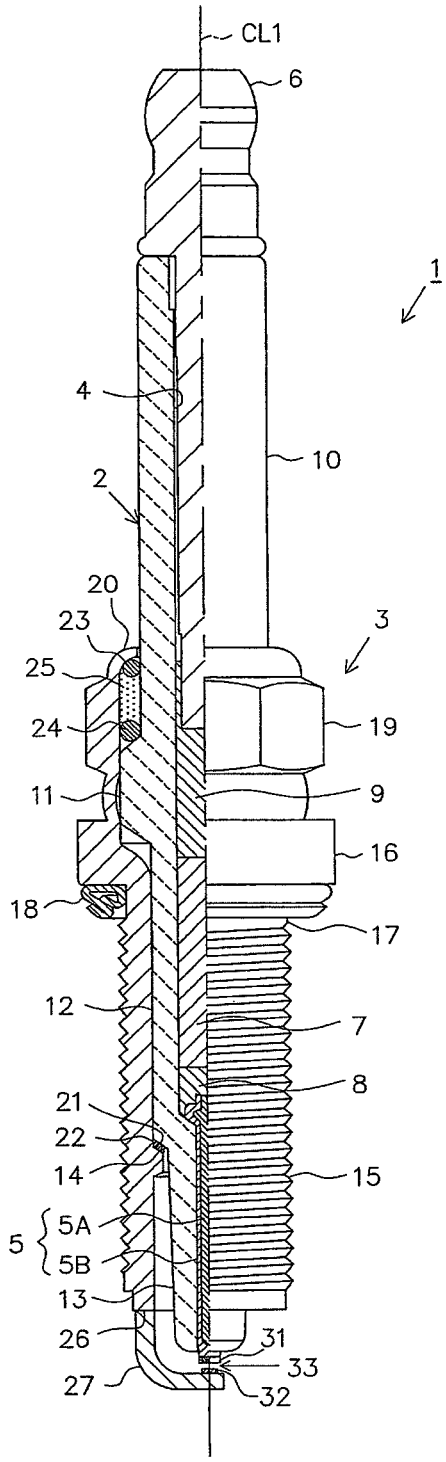
FIG. 1 is a partially cutaway front view of a spark plug to which the present invention is embodied.

A first embodiment of the present invention will be described below with reference to the drawings. FIG. 1 is a partially cutaway front view of a spark plug 1 according to the first embodiment of the present invention. In the following description, the direction of an axis CL1 of the spark plug 1 is referred to as a vertical direction in FIG. 1; and the bottom and top sides in FIG. 1 are defined as front and rear sides of the spark plug 1, respectively.

The spark plug 1 includes a ceramic insulator 2 as a cylindrical insulator and a cylindrical metal shell 3 retaining therein the ceramic insulator 2.

The ceramic insulator 2 is formed by sintering alumina etc., as is commonly known, into an outside shape that defines a rear body portion 10 at a rear end thereof, a large-diameter portion 11 radially outwardly protruding on a front side of the rear body portion 10, a middle body portion 12 located on a front side of the large-diameter portion 11 and made smaller in diameter than the large-diameter portion 11 and a leg portion 13 located on a front side of the middle body portion 12 and made smaller in diameter than the middle body portion 12. A tapered step 14 is formed at a connection between the leg portion 13 and the middle position 12 so that the ceramic insulator 2 is retained at the tapered step 14 on the metal shell 3.

Further, an axial hole 4 is formed through the ceramic insulator 2 along the axis CL1. The spark plug 1 includes a center electrode 5 inserted and fixed in a front side of the axial hole 4. The center electrode 5 has, as a whole, a rod shape (cylindrical shape) with a front end face thereof flattened and protruding from a front end of the ceramic insulator 2. Herein, the center electrode 5 consists of an inner layer 5A of copper or a copper alloy and an outer layer 5B of a Ni-based alloy. The spark plug 1 also includes a cylindrical noble metal tip 31 formed of a noble metal alloy (such as iridium alloy or platinum alloy) and joined to a front end portion of the center electrode 5.

The spark plug 1 further includes a terminal electrode 6 inserted and fixed in a rear side of the axial hole 4 and partially protruding from a rear end of the ceramic insulator 2.

A cylindrical resistive element 7 is arranged between the center electrode 5 and the terminal electrode 6 in the axial hole 4 and is electrically connected at opposite ends thereof to the center electrode 5 and the terminal electrode 6 through conductive glass seal layers 8 and 9.

The metal shell 3 is formed of a metal material such as low-carbon steel into a cylindrical shape and has a thread portion (external thread portion) 15 formed on an outer circumferential surface thereof for mounting the spark plug 1 to a combustion device (e.g. internal combustion engine) and a seat portion 16 formed on the outer circumferential surface thereof on a rear side of the thread portion 15. A ring-shaped gasket 18 is fitted on a thread neck 17 at a rear end of the thread portion 15. The metal shell 3 also has a tool engagement portion 19 of substantially hexagonal cross section formed on a rear side thereof so as to engage with a tool such as a wrench for fixing the metal shell 3 to the combustion device and a swaged portion 20 formed at a rear end thereof to retain the ceramic insulator 2.

On the other hand, a tapered step 21 is formed on an inner circumferential surface of the metal shell 3 to engage thereon the ceramic insulator 2. The ceramic insulator 2 is thus inserted from the rear side to the front side of the metal shell 3 and fixed in the metal shell 3 by swaging a rear end opening of the metal shell 3 radially inwardly, i.e., forming the swaged portion 20 while engaging the step 14 of the ceramic insulator 2 on the step 21 of the metal shell 3. An annular plate packing 22 is held between the steps 14 and 21 of the ceramic insulator 2 and the metal shell 3 so as to maintain the gas tightness of the combustion chamber and thereby prevent fuel-air mixture entering into a space between the leg portion 13 of the ceramic insulator 2 and the inner circumferential surface of the metal shell 3 from leaking to the outside.

In order to secure more complete sealing by swaging, annular ring members 23 and 24 are interposed between the ceramic insulator 2 and the metal shell 3; and a talc powder 25 is filled between the ring members 23 and 24. Namely, the metal shell 3 retains therein the ceramic insulator 2 via the plate packing 22, the ring members 23 and 24 and die talc 25.

Figure 2:
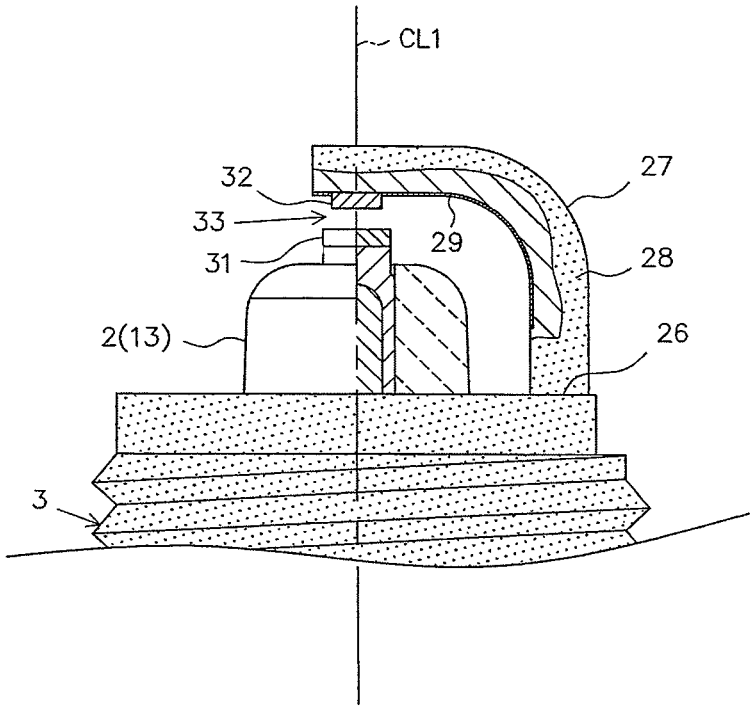
FIG. 2 is a partially cutaway front view of a front end part of the spark plug.

As shown in FIG. 2, the spark plug 1 further includes a ground electrode 27 made of a Ni-based alloy and joined to a front end potion 26 of the metal shell 3 and a cylindrical noble metal tip 32 formed of a noble metal alloy (such as platinum alloy) disposed on a front end portion of the ground electrode 27 protrudingly toward the center electrode 5. The noble metal tip 32 is herein joined by resistance welding to the ground electrode 27. There is a spark gap 33 defined between the noble metal tips 31 and 32 so that a spark discharge occurs in the spark gap 33 in a direction substantially along the axis CL1.

In the present embodiment, a Ni plating layer 28 is formed as a Ni-based plating layer on a surface of a part of the ground electrode 27 other than a front end part of a lateral surface of the ground electrode 27 on the side of the center electrode 5 and on a surface of the metal shell 3 (as indicated by a dot pattern). Herein, the Ni plating layer 28 can be formed as follows. A Ni plating film is applied as a Ni-based plating film to the whole of the surfaces of the metal shell 3 and the ground electrode 27. A laser beam is then irradiated to the front end part of the lateral surface of the ground electrode 27 on the side of the center electrode 5. With this, the Ni plating film is removed from the front end part of the lateral surface of the ground electrode 27 on the side of the center electrode 5 so that the remainder of the Ni plating film is defined as the Ni plating layer 28. The Ni plating layer 28 is herein formed with a relatively small thickness (for example, about 10 μm).

Figure 3:
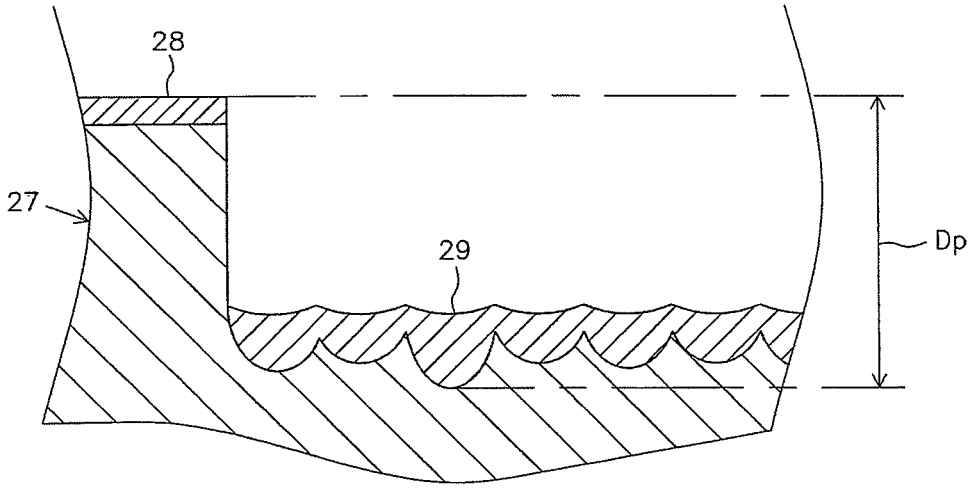
FIG. 3 is an enlarged section view of a part showing the structure of a molten layer and the like according to a first embodiment of the present invention.

Further, a molten layer 29 is formed on the laser-irradiated part of the lateral surface of the ground electrode 27 on the side of the center electrode 5. (In FIG. 2, the molten layer 29 is illustrated with a large thickness for the sake of convenience.) The molten layer 29 is herein formed by melting the metal material of the Ni plating film and the metal material (Ni alloy) of the ground electrode 27 together. As shown in FIG. 3, the maximum length Dp between a surface of the Ni plating layer 28 (a point of the surface of the plating layer 28 closest to the molten layer 29) and a point of the molten layer 29 opposite from the surface of the plating layer 28 in a thickness direction of the ground electrode 27 (i.e., the apparent molten layer thickness) is controlled to be larger than or equal to a thickness of the Ni plating layer 28 and be smaller than or equal to 200 μm. The surface of the molten layer 29 is more recessed than the surface of the Ni plating layer 28 due to the occurrence of abrasion (gasification, vaporization) of the metal materials of the Ni plating film and the ground electrode 27 during the laser beam irradiation processing (laser processing). The surface of the molten layer 29 is also formed with a fine roughness.

A production process of the above-structured spark plug 1 will be next explained below. First, the metal shell 3 is processed in advance. More specifically, a metal material (e.g. iron-based or stainless material such as S17C or S25C) of cylindrical shape is subjected to cold forging, thereby cutting a through hole in the cylindrical metal material and forming the cylindrical metal material into a general shape. The outer shape of the metal material is then adjusted. The resulting metal material is used as a semifinished metal shell part.

The ground electrode 27 is prepared in the form of a straight rod of Ni alloy and resistance welded to a front end face of the semifinished metal shell part. There occurs a burr or burrs during the welding. After removing such a welding burr or buns, the thread portion 15 is formed by component rolling on a given area of the semifinished metal shell part. In this way, the metal shell 3 to which the ground electrode 27 has been welded is obtained.

Figure 4:
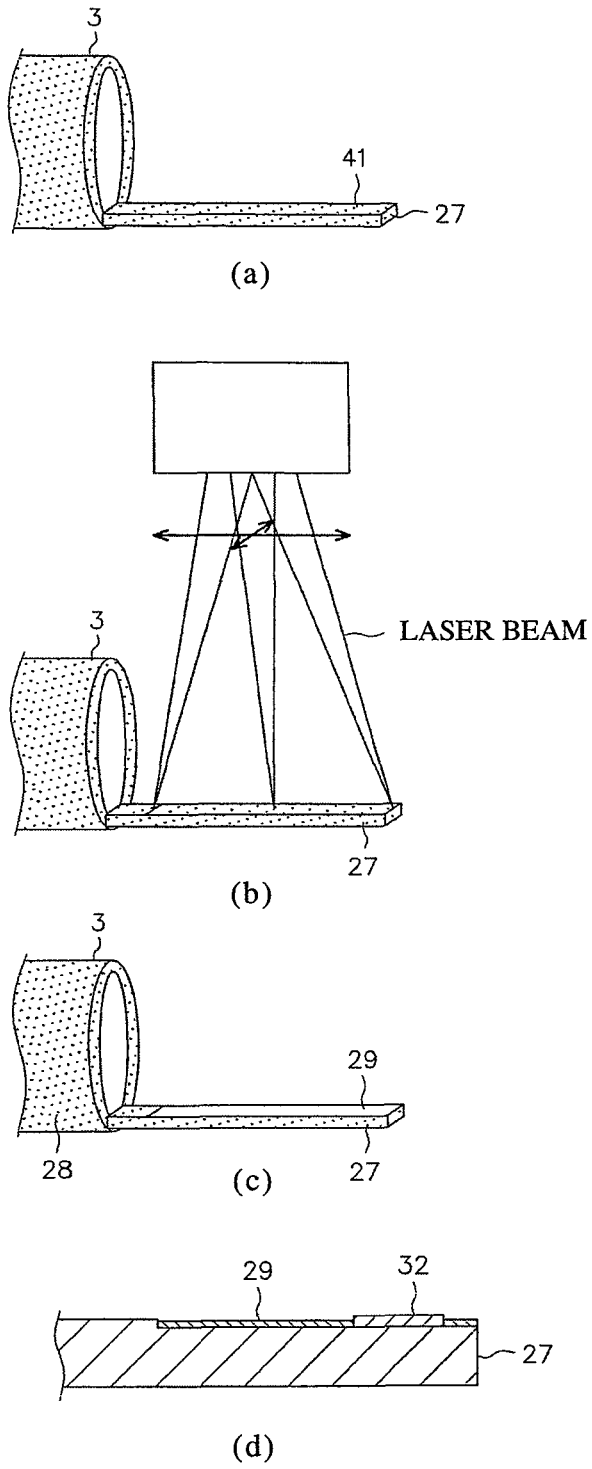
FIGS. 4(*a*) to (*c*) are enlarged schematic views showing how the molten layer is formed on a front end portion of a ground electrode according to the first embodiment of the present invention.

Next, in a plating film application step, a Ni plating film 41 containing Ni as a main component is applied by a barrel plating machine (not shown) to the whole of the surfaces of the metal shell 3 and the ground electrode 27 as shown in FIG. 4(*a*). Subsequently, in a molten layer formation step, the front end part of the lateral surface of the ground electrode 27 on the side of the center electrode 5 is laser processed by moving the irradiation position of the laser beam as shown in FIG. 4(*b*). With this, the Ni plating film 41 is removed from the laser-processed part to thereby form the molten layer 29 on the laser-processed part and define the remainder of the Ni plating film 41 as the Ni plating layer 29 as shown in FIG. 4(*c*). In the laser processing, the laser beam is irradiated with a relatively high melting energy in such a manner as to control the apparent molten layer thickness Dp to be larger than or equal to the thickness of the Ni plating layer 29 (Ni plating film 41). The molten layer 29 is thus formed by melting both of the metal material of the Ni plating film 41 and the metal material (Ni alloy) of the ground electrode 27 rather than by melting only the metal material of the Ni plating film 41. On the other hand, the melting energy of the laser beam is limited so as not to become excessively high and thereby so as to control the apparent thickness Dp of the molten layer 29 to 200 μm or smaller.

After that, the noble metal tip 29 is pressed against and resistance welded to a given area of the molten layer 29 on the front end portion of the ground electrode 27. As the molten layer 29 is formed with a relatively small thickness (200 μm or smaller) as mentioned above, the noble metal tip 29 is welded to not only the molten layer 29 but also the ground electrode 27 as shown in FIG. 4(*d*).

Further, the ceramic insulator 2 is formed by e.g. preparing a granulated molding material from an alumina-based raw powder containing a binder, molding the prepared material into a cylindrical body by rubber press molding, shaping the molded body by cutting, and then, sintering the molded body in a sintering furnace.

The center electrode 5 is formed separately from the metal shell 3 and the ceramic insulator 2. More specifically, the center electrode 5 is prepared by forging a Ni alloy material containing in the center thereof a copper alloy for improvement in thermal radiation performance. The noble metal tip 31 is then joined by laser welding etc. to the front end portion of the center electrode 5.

The ceramic insulator 2, the center electrode 5, the resistive element 7 and the terminal electrode 6 are fixed together via the glass seal layers 8 and 9. A material of the glass seal layers 8 and 9 is generally prepared by mixing borosilicate glass with a metal powder. The prepared material is filled into the axial hole 4 of the ceramic insulator 2 in such a manner as to sandwich therebetween the resistive element, and then, solidified by sintering in a sintering furnace with the terminal electrode 6 pressed from the rear. At this time, a glazing layer may formed simultaneously, or in advance, on the surface of the rear body portion of the ceramic insulator 2.

After that, the ceramic insulator 2 to which the center and terminal electrodes 5 and 6 have been fixed and the metal shell 3 to which the ground electrode 27 has been fixed are assembled together by swaging the relatively-thin rear opening end of the metal shell 3 radially inwardly and thereby forming the swaged portion 20.

Finally, the ground electrode 27 is bent toward the center electrode 5 in such a manner as to adjust the discharge gap between the noble metal tips 31 and 32. Consequently, the above-mentioned spark plug 1 is completed.

As mentioned above, in the present embodiment, the molten layer 29 in which the metal material (Ni alloy) of the ground electrode 27 and the metal material of the Ni plating film 41 are molten together is formed on the part of the to-be-bent portion of the ground electrode 27 on the side of the center electrode 5 by irradiation of at least the part of the plating film 41 applied thereto with the laser beam. In other words, the irradiation of the laser beam enables removal of the Ni plating film 41 that has relatively poor adhesion to the ground electrode 27, and at the same time, formation of the molten layer 29 on the surface of the ground electrode 29. This molten layer 29, in which the Ni alloy of the ground electrode 27 and the Ni component of the Ni plating film 41 are molten together, has relatively good adhesion to the ground electrode 27. As the Ni plating film 41 has been removed from the to-be-bent portion of the ground electrode 27, no separation of the Ni plating film 41 occurs during the bending of the ground electrode 27. Further, almost no separation of the molten layer 29 occurs during the bending of the ground electrode 27 as the molten layer 29 has good adhesion to the ground electrode 27. It is therefore possible to limit the occurrence of an abnormal spark discharge between the center electrode 5 and the ground electrode 27 and prevent deterioration in the ignition performance of the spark plug more assuredly.

In addition, the Ni plating film 41 is removed by irradiation of the laser beam. It is thus possible to obtain substantial cost decrease and dramatic workability improvement, as compared to the prior art technique of removing a plating film by immersing a front end portion of a ground electrode in an acidic remover and to the prior art technique of forming a plating film after applying a masking treatment to a ground electrode.

In the case of using the noble metal tip 32, it is possible to provide reduction in contact area between the noble metal tip 32 and the molten layer 29, and by extension, increase in contact resistance between the noble metal tip 32 and the molten layer 29 during the resistance welding as the molten layer 29 is formed with a fine surface roughness by irradiation of the laser beam on the joint part of the ground electrode 27 to which the noble metal tip 32 is joined. The noble metal tip 32 can be thus joined with sufficient strength even in the case where the pressure for pressing the noble metal tip 32 against the ground electrode 27, or the welding current applied, is decreased to a relatively small level.

Furthermore, the apparent molten layer thickness is controlled to a relatively small thickness of 200 μm or smaller so that it is possible to prevent deterioration in the adhesion of the molten layer 29 to the ground electrode 27 more assuredly and possible to join the noble metal tip 32 to not only the molten layer 29 but also the ground electrode 27 more assuredly. The noble metal tip 32 can be thus joined with higher joint strength and prevented from separation effectively.

[Second Embodiment]

Figure 9:
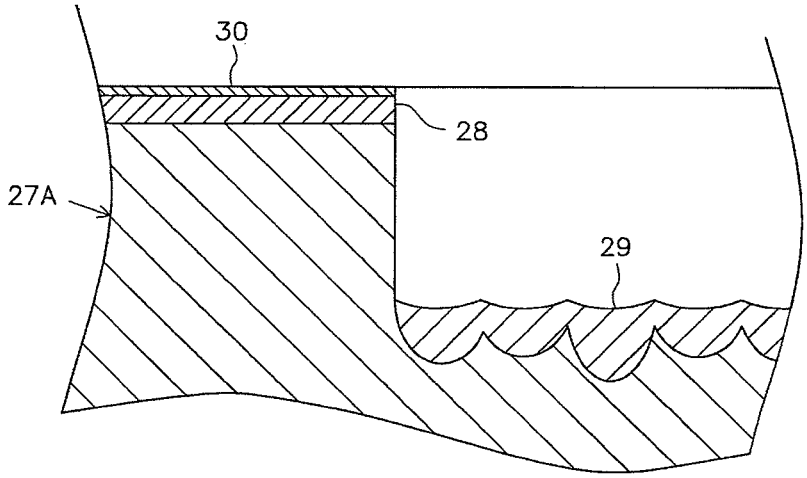
FIG. 9 is an enlarged section view of a part showing the structure of a chromate film layer and the like according to a second embodiment of the present invention.

Referring to FIG. 9, a second embodiment of the present invention will be described below with particular emphasis on the difference between the first and second embodiments.

In the second embodiment, there is used a ground electrode 27A made of a Ni-based alloy containing Ni as a main component and a predetermined amount (for example, 10 mass % or more) of chromium (Cr) (such as Inconel (trademark) having a Cr content of about 22 mass %).

Further, a Ni plating layer 28 is formed as a Ni-based plating layer on a surface of a part of the ground electrode 27A other than a front end part of a lateral surface of the ground electrode 27A on the side of the center electrode 5 and on the surface of the metal shell 3. A chromate film layer 30 is also formed on the Ni plating layer 28. Herein, the Ni plating layer 28 and the chromate film layer 30 can be formed as follows. A Ni plating film is applied as a Ni-based plating film to the whole of the surfaces of the metal shell 3 and the ground electrode 27A. Then, a chromate treatment is performed on the whole of the surfaces of the metal shell 3 and the ground electrode 27A to form a double coating in which a chromate film is laminated on the Ni plating film. A laser beam is irradiated to the front end part of the lateral surface of the ground electrode 27A on the side of the center electrode 5. With this, the double coating is removed from the front end part of the lateral surface of the ground electrode 27A on the side of the center electrode 5. The Ni plating layer 28 and the chromate film layer 30 are thus defined on the given part of the surface of the ground electrode 27 and on the surface of the metal shell 3 by the remainder of the double coating.

In the second embodiment, the diffusion of Cr from the chromate film layer 30 on the surface of the ground electrode 27A to the Ni plating layer 28 occurs, prior to the diffusion of Cr from the ground electrode 27A to the Ni plating layer 28, under high temperature conditions during use. It is thus possible to prevent the diffusion of Cr from the ground electrode 27A to the Ni plating layer 28 more assuredly and exert a sufficient oxidation resistance improvement effect.

[Third Embodiment]

Figure 10:
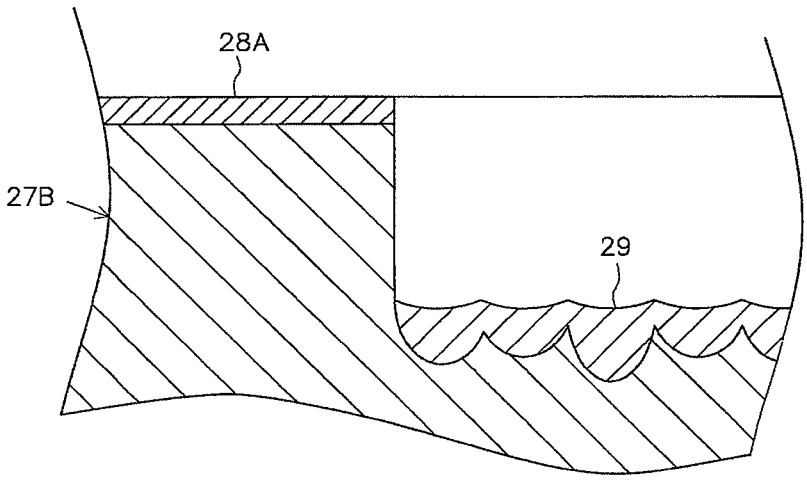
FIG. 10 is an enlarged section view of a part showing the structure of a Ni plating layer and the like according to a third embodiment of the present invention.

Referring to FIG. 10, a third embodiment of the present invention will be described below with particular emphasis on the difference between the first and third embodiments.

In the third embodiment, there is used a ground electrode 27B made of a Ni-based alloy containing Ni as a main component and a predetermined amount (for example, 10 mass % or more) of Cr.

Further, a Ni plating layer 28A is formed on a surface of a part of the ground electrode 27B other than a front end part of a lateral surface of the ground electrode 27B on the side of the center electrode 5 and on the surface of the metal shell 3. Herein, the Ni plating layer 28A can be formed as follows. A Ni plating film containing Ni as a main component and 3 to 30 mass % Cr is applied to the whole of the surfaces of the metal shell 3 and the ground electrode 27B. A laser beam is irradiated to the front end part of the lateral surface of the ground electrode 27B on the side of the center electrode 5. With this, the Ni plating film is removed from the front end part of the lateral surface of the ground electrode 27B on the side of the center electrode 5 so that the remainder of the Ni plating film is defined as the Ni plating layer 28A that contains Ni as a main component and 3 to 30 mass % Cr.

In the third embodiment, the Ni plating layer 28A has a Cr content of 3 to 30 mass %. It is thus possible to effectively limit the diffusion of Cr from the ground electrode 27B to the Ni plating layer 28 even under high temperature conditions and exert a sufficient oxidation resistance improvement effect due to the addition of Cr into the ground electrode 27.

In order to verify the functions and effects of the above embodiments, plating separability tests were conducted. The detailed procedures of the plating separability tests are as follows. Rod-shaped ground electrodes, each having a Ni plating film of 10 μm thickness applied to the whole surface thereof and irradiated with a laser beam to form a molten layer, were prepared as samples by applying Ni plating films of 10 μm thickness to the whole surfaces of the ground electrodes and forming molten layers with laser beam irradiation. The output of the laser beam was adjusted to vary the apparent thickness of the molten layer. Herein, five samples were prepared for each apparent molten layer thickness. Each of the samples was heated with a burner and held for 1 minute at 900° C., left to cool by itself to room temperature, and then, bent into a right angle. The occurrence of separation of the Ni plating film at the bent portion of the sample was checked by visual inspection. The separability of the plating film was evaluated as: "X" when the separation of the Ni plating film was found in all of the five samples of the same apparent molten layer thickness; "Δ" when the separation of the Ni plating film was found in at least one of the five samples of the same apparent molten layer thickness; and "○" when the separation of the Ni plating film was not found in any of the five samples of the same apparent molten layer thickness. The apparent molten layer thicknesses and the evaluation results of the samples are indicated in TABLE 1.

TABLE 1

| Apparent molten layer thickness | Evaluation |
|---|---|
| 3 μm | X |
| 5 μm | X |
| 8 μm | Δ |
| 10 μm | ○ |
| 15 μm | ○ |
| 20 μm | ○ |

As shown in TABLE 1, the separation of the Ni plating film occurred in the samples where the apparent molten layer thickness was smaller than 10 μm, i.e., smaller than the thickness of the Ni plating film. It is assumed that this is because the molten layer was formed by melting only the Ni component of the Ni plating film, but not melting the Ni alloy of the ground electrode, due to the relatively low output of the laser beam so that the Ni plating film, which did not have sufficient adhesion to the ground electrode, remained below the molten layer.

By contrast, the separation of the Ni plating film did not occur at all in the samples where the apparent molten layer thickness was larger than or equal to 10 μm, i.e., larger than or equal to the thickness of the Ni plating film. I is assumed that this is because: the molten layer was formed by melting the Ni alloy of the ground electrode and the Ni component of the Ni plating film due to the relatively high output of the laser beam so that the Ni plating film, which did not have sufficient adhesion to the ground electrode, disappeared; and the resulting molten layer contained the Ni alloy material of the ground electrode and had good adhesion to the ground electrode.

It has been shown by the above plating separability test results that it is preferable to adjust the output of the laser beam etc. in such a manner as to control the apparent molten layer thickness to be larger than or equal to the thickness of the Ni plating film (Ni plating layer).

Figure 5:
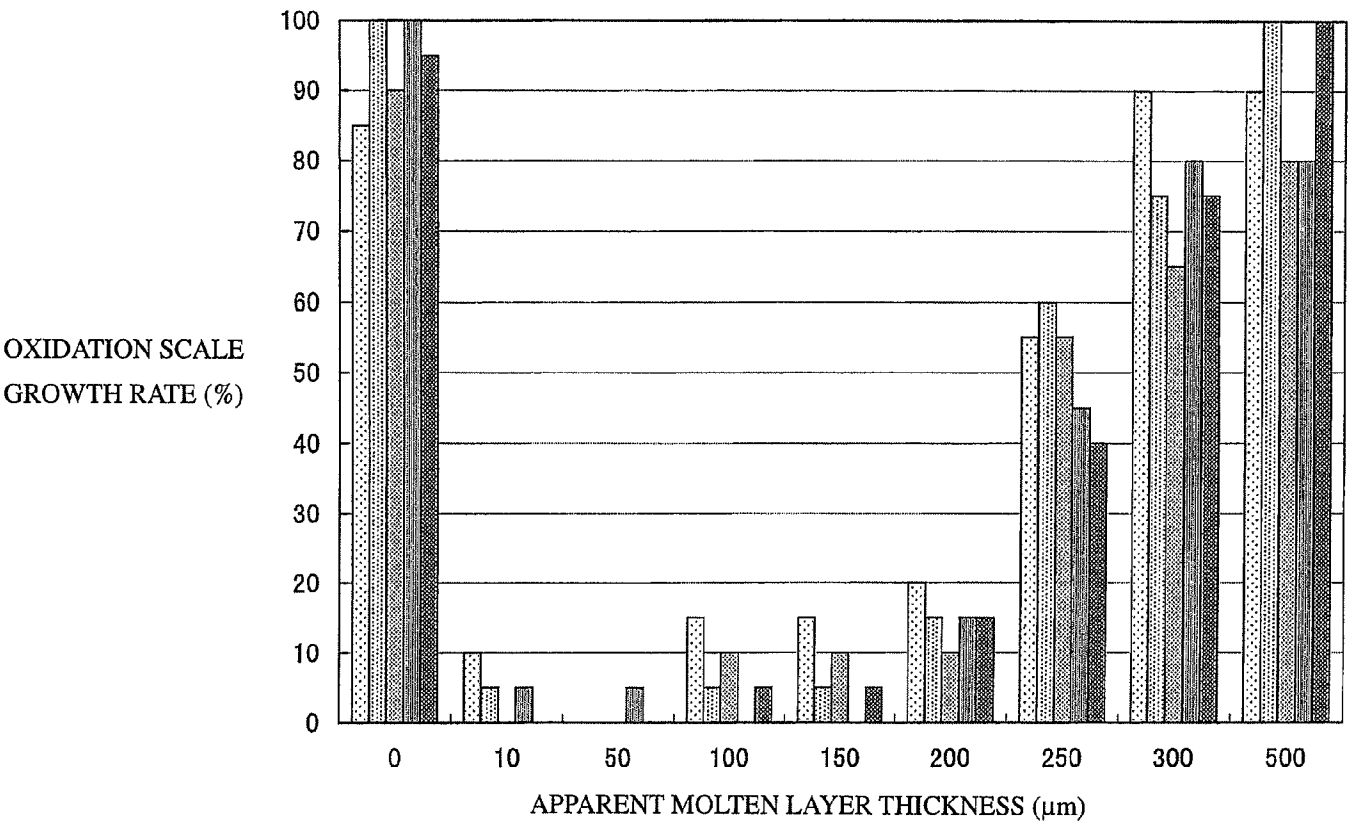
FIG. 5 is a graph of the relationship between an apparent thickness of the molten layer and a growth rate of oxidation scale.

Next, chip separability tests were conducted on spark plug samples of different apparent molten layer thicknesses. Herein, five samples were prepared for each apparent molten layer thickness. In each of the samples, a noble metal tip was joined by resistance welding to a ground electrode. The detailed procedures of the chip separability tests are as follows. The sample was mounted on an in-line 6-cylinder 2000-cc DOHC engine. The engine was subjected to 1000 cycles of idling for 1 minute and running at a load (a revolution speed of 6000 rpm) for 1 minute. After the completion of 1000 cycles of idling and load-running, the section of the sample was observed to determine the rate of the length of a developed oxidation scale to the length of an interface region between the noble metal chip and the part to which the noble metal chip was joined (referred to as "oxidation scale development rate"). In FIG. 5, there is shown a graph of the relationship between the apparent molten layer thickness and oxidation scale development rate of the sample. When the apparent molten layer thickness was 0 μm, the sample had a Ni plating layer on the whole surface of the ground electrode without the formation of a molten layer (i.e. without being subjected to laser processing). On the other hand, the sample was formed with a molten layer by applying a Ni plating film of 10 μm thickness to the surface of the ground electrode followed by laser processing.

As shown in FIG. 5, the sample had an oxidation scale development rate exceeding 85% when the apparent molten layer thickness of the sample was 0 μm (the sample was unprocessed). It is assumed that this is because: the Ni plating film was present at the surface of the ground electrode so that most of the joint area of the noble metal tip was joined to the Ni plating film that did not have sufficient adhesion to the ground electrode; and, when the sample was heated in this state, there occurs rapid oxidation of the Ni plating film that was poor in oxidation resistance.

When the apparent molten layer thickness of the sample was 250 μm or greater, the sample had an oxidation scale development rate that was more favorable than that of the unprocessed sample but could exceed 50%. It is assumed that this is because that the molten layer was formed with a relatively large thickness so that the noble metal tip was joined only to the molten layer (i.e. the noble metal tip was not joined to the ground electrode), which led to slight deterioration in the adhesion of the noble metal tip to the ground electrode.

By contrast, the sample had an oxidation scale development rate of less than 50% and attained a very high separation resistance of the noble metal tip when the apparent molten layer thickness (Ni plating film thickness) of the sample was in the range of 10 to 200 μm. It is assumed that this is because the noble metal tip was joined to not only the molten layer but also the ground electrode since the Ni plating film was sufficiently removed from the surface of the ground electrode, and at the same time, the molten layer was relatively small in thickness.

It can be thus concluded that it is effective to perform laser processing in such a manner as to control the apparent molten layer thickness to be larger than or equal to the thickness of the Ni plating film and be smaller than or equal to 200 μm in order to prevent the occurrence of separation of the plating film during the bending of the ground electrode and, in the case of joining the noble metal tip to the ground electrode, to achieve good separation resistance of the noble metal tip.

Subsequently, desktop burner heating tests were conducted on spark plug samples with Cr-containing ground electrodes, in one of which a chromate film was formed on a Ni plating layer (Sample A) and in the other of which a chromate film was not formed on a Ni plating layer (Sample B). The detailed procedures of the desktop burner heating tests are as follows. The sample was subjected to 1000 cycles of heating for 2 minutes with a burner to thereby control the temperature of the ground electrode to 950° C. and cooling for 1 minute. After the completion of 1000 cycles of heating and cooling, the section of the sample was observed to check the occurrence or non-occurrence of the growth of Ni particles at the section of the sample. The desktop burner heating test results of the samples are indicated in TABLE 2.

TABLE 2

| | Ni particle growth |
|---|---|
| Sample A | Not occurred |
| Sample B | Occurred |

As shown in TABLE 2, the Ni particle growth occurred in the ground electrode of Sample B where the chromate film was not formed on the Ni plating layer, which resulted in lower oxidation resistance. It is assumed that this is because the diffusion of Cr from the ground electrode to the Ni plating layer occurred under high temperature conditions.

By contrast, the Ni particle growth did not occur in the ground electrode of Sample A where the chromate film was formed on the Ni plating layer, which led to high oxidation resistance. It is assumed that this is because: the diffusion of Cr from the chromate film on the ground electrode to the Ni plating layer occurred prior to the diffusion of Cr from the ground electrode to the Ni plating layer; and as a result, the diffusion of Cr from the ground electrode to the Ni plating layer was prevented more assuredly.

Further, a plurality of spark plug samples with Cr-containing ground electrodes and Ni plating layers of different Cr contents were prepared. Each of the samples was subjected to desktop burner heating test in the same manner as above and was also subjected to adhesion evaluation test.

The adhesion evaluation test was herein conducted by, after applying the Ni plating to the rod-shaped ground electrode, bending the ground electrode and then checking the occurrence of separation of the Ni plating layer at the side of the ground electrode opposite from the center electrode. The adhesion of the Ni plating layer was evaluated as: "○" when the separation of the Ni plating layer did not occur in the sample; and "X", meaning that there was a possibility of an abnormal discharge, when the separation of the Ni plating layer occurred in the sample. The desktop burner heating test results and adhesion evaluation test results are indicated in TABLE 3.

TABLE 3

| Chromium content (mass %) | Adhesion | Ni particle growth |
|---|---|---|
| 0 | ○ | Occurred |
| 2 | ○ | Occurred |
| 3 | ○ | Not occurred |

TABLE 3-continued

| Chromium content (mass %) | Adhesion | Ni particle growth |
|---|---|---|
| 10 | ○ | Not occurred |
| 15 | ○ | Not occurred |
| 20 | ○ | Not occurred |
| 25 | ○ | Not occurred |
| 30 | ○ | Not occurred |
| 35 | X | Not occurred |

As shown in TABLE 3, the Ni particle growth occurred in the samples where the Cr content of the Ni plating layer was less than 3 mass %. The oxidation resistance of these samples was thus insufficient. It is assumed that this is because the diffusion of Cr from the ground electrode to the Ni plating layer was not sufficiently prevented due to the too low Cr content of the Ni plating layer.

In the sample where the Cr content of the Ni plating layer exceeded 30 mass %, the occurrence of the Ni particle growth was prevented. The Ni plating layer was however easy to separate. It is assumed that this is because the adhesion of the Ni plating layer to the ground electrode was deteriorated due to the too high Cr content of the Ni plating layer.

By contrast, both of the occurrence of the Ni particle growth and the separation of the Ni plating layer were prevented effectively in the samples where the Cr content of the Ni plating layer was controlled to 3 to 30 mass %.

Based on the above test results, it can be concluded that, in the case of adding Cr in the ground electrode, it is preferable to form the chromate film on the Ni plating layer and to form the Ni plating layer with a Cr content of 3 mass % or more in order to prevent the occurrence of the Ni particle growth in the ground electrode.

It can also be concluded that, in the ease of adding Cr in the Ni plating layer, it is preferable to control the Cr content of the Ni plating layer to 30 mass % or less in order to secure sufficient separation resistance of the Ni plating layer.

The present invention is not limited to the above-mentioned embodiments and may alternatively be embodied as follows. It is needless to say that any application examples and modification examples other than the following embodiments are possible.

(a) The molten layer 29 is formed by laser processing in the above embodiments, but can alternatively be formed by irradiation with an electron beam.

(b) Further, the molten layer 29 may be formed by laser processing in a vacuum or by laser processing with blowing an assist gas such as nitrogen, helium or argon gas onto the work surface although not specifically so explained in the above embodiments. In this case, it is possible to effectively prevent the molten layer 29 from oxidation for improvement in durability.

(c) In the above embodiments, the thickness of the Ni plating film 41 is set to 10 μm. There is however no particular restriction on the thickness of the Ni plating film 41 as long as the Ni plating layer 28 shows sufficient corrosion resistance. In the case of changing the thickness of the Ni plating film 41, it is necessary to adjust the output of the laser beam etc. as appropriate in such a manner that the apparent molten layer thickness becomes larger than or equal to the thickness of the Ni plating layer 28.

Figure 6:
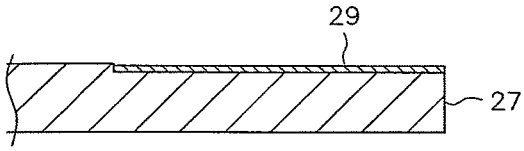
FIGS. 6(*a*) to (*c*) are enlarged section views of front end portions of ground electrodes according to other embodiments of the present invention.
Figure 6:
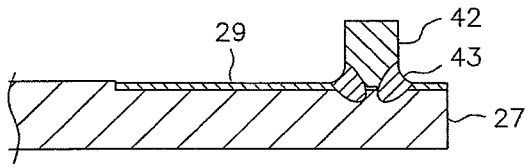
Figure 6:
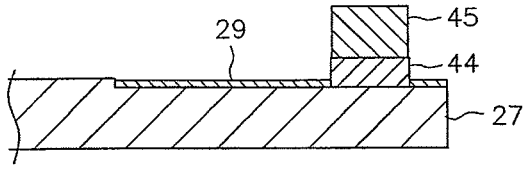

(d) Although the noble metal tip 32 is disposed on the ground electrode 27 in the above embodiments, this noble metal tip 32 may be omitted as shown in FIG. 6(*a*). (FIGS. 6(*a*) to (*c*) each shows the ground electrode 27 before subjected to bending.) As shown in FIG. 6(*b*), a noble metal tip 42 can be joined to the ground electrode 27 via a melt joint 43 by laser welding in place of resistance welding or by combination of laser welding and resistance welding although the noble metal tip 32 is joined by resistance welding in the above embodiments.

Further, a noble metal tip 45 may be indirectly joined to the ground electrode 27 through a relief tip 44 as shown in FIG. 6(*c*) although the noble metal tip 32 is directly joined to the ground electrode 27 in the above embodiments. In order to relieve the stress caused by differences in thermal expansion at the joints between the ground electrode 27 and the relief tip 44 and between the noble metal tip 45 and the relief chip 44, the relief chip 44 is preferably formed of a metal material having a linear expansion coefficient between a linear expansion coefficient of the Ni alloy of the ground electrode 27 and a linear expansion coefficient of the noble metal alloy of the noble metal tip 45. It is possible to obtain further improvement in the separation resistance of the noble metal tip 45 by forming the relief chip 44 of the metal material having a linear expansion coefficient between the linear expansion coefficient of the Ni alloy of the ground electrode 27 and the linear expansion coefficient of the noble metal alloy of the noble metal tip 45.

Figure 7:
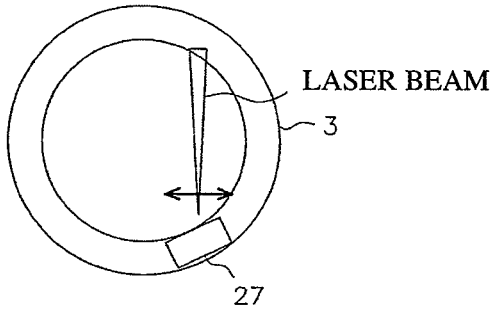
FIG. 7 is a schematic plan view showing a laser processing technique according to another embodiment of the present invention.

(e) In the above embodiments, the laser processing is performed on the lateral side of the ground electrode 27 facing the center electrode 5. It is alternatively feasible to perform the laser processing on the lateral side of the ground electrode 27 facing the center electrode 5 as well as the lateral sides of the ground electrode 27 adjacent thereto by slightly rotating the ground electrode 27 about it center axis during the laser processing as shown in FIG. 7.

Figure 8:
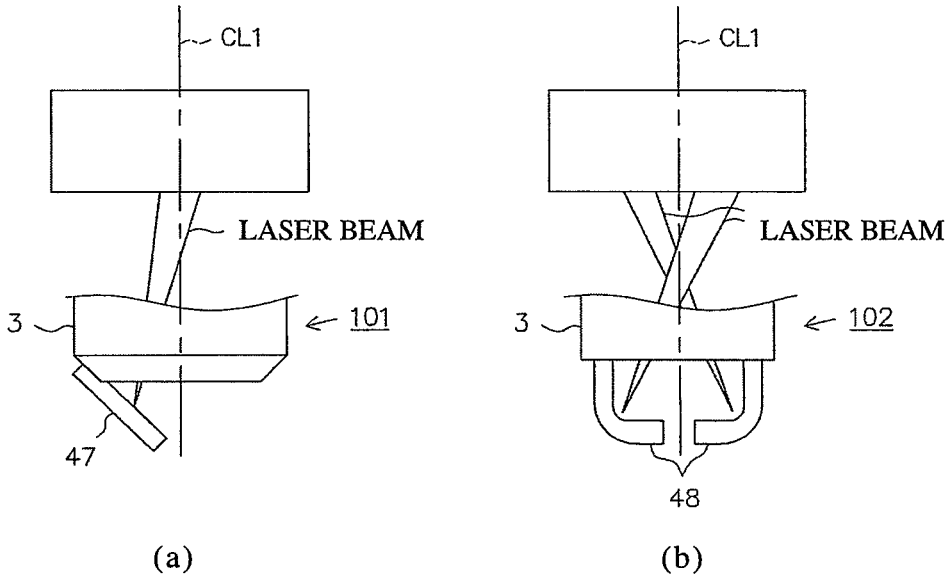
FIGS. 8(*a*) and (*b*) are enlarged front views of parts of ground electrodes according to other embodiments of the present invention.

(f) Although the technical idea of the present invention is applied to the spark plug 1 having a single ground electrode 27 with its rear end portion extending along the axis CL in the above embodiments, there is no particular restriction on the form and number of the ground electrode to which the technical idea of the present invention is applicable. As shown in FIG. 8(*a*), the technical idea of the present invention is applicable to a spark plug 101 having a ground electrode 47 extending inclinedly relative to the axis CL1. Further, the technical idea of the present invention is also applicable to a spark plug 102 having a plurality of ground electrodes 48 bent toward the axis CL1 as shown in FIG. 8(*b*). In this case, laser processing or electron beam processing can be relatively easily performed by irradiation of a laser beam or electron beam through the metal shell 3. As the ground electrode 47, 48 is slightly bent to make fine adjustment of the spark gap size in the spark plug 101, 102, it is possible to more assuredly prevent separation of the Ni plating film at the time of bending of the ground electrode 47, 48.

(g) The surface of the molten layer 29 may be subjected to smoothening (e.g. additional laser processing) although not specifically so explained in the above embodiments. By smoothening the surface roughness of the molten layer 29 where the electric field strength is likely to be relatively high, it is possible to effectively prevent the occurrence of an abnormal spark discharge between the center electrode 5 (noble metal tip 31) and the molten layer 29 for further improvement in ignition performance.

(h) Although the noble metal tip 31 is provided on the front end portion of the center electrode 5 in the above embodiments, this noble metal tip 31 may be omitted.

(i) In the above embodiments, the ground electrode 27 is joined to the front end face of the metal shell 3. These embodiments are applicable to the case where the ground electrode is formed by cutting a part of the metal shell (or a front metal attachment previously welded to the metal shell). (See, for example, Japanese Laid-Open Patent Publication No. 2006-236906.) Further, the ground electrode 27 may alternatively be joined to a lateral side of the front end portion 26 of the metal shell 3.

(i) The tool engagement portion 19 is hexagonal in cross section in the above embodiments, but is not limited to such a form. For example, the form of the tool engagement portion 19 may be of Bi-HEX (12-point) design (according to ISO 22977:2005(E)) or the like.

(k) In the above embodiments, the internal combustion engine is used as the combustion device. The combustion device to which the spark plug 1 is applicable is not however limited to the internal combustion engine. The spark plug 1 can be used for ignition in, for example, a burner of a fuel reforming unit or a boiler.

| Description of Reference Numerals and Signs | |
|---|---|
| 1, 101, 102: | Spark plug |
| 2: | Ceramic insulator (Insulator) |
| 3: | Metal shell |
| 4: | Axial hole |
| 5: | Center electrode |
| 27, 47, 48: | Ground electrode |
| 28: | Ni plating layer (Plating layer) |
| 29: | Molten layer |
| 41: | Ni plating film (Plating film) |
| CL1: | Axis |

The invention claimed is:

1. A spark plug comprising:

a rod-shaped center electrode extending in an axis direction of the spark plug;

a cylindrical insulator having an axial hole formed therein in the axis direction and retaining the center electrode in the axial hole;

a cylindrical metal shell disposed on an outer circumference of the insulator; and a ground electrode made of a nickel-based alloy, extending from a front end portion of the metal shell and bent at a substantially middle portion thereof in such a manner as to define a spark gap between a front end portion of the ground electrode and a front end portion of the center electrode, wherein the spark plug further comprises:

a molten layer in which a metal material of a nickel-based plating layer applied to at least a center-electrode-side part of the portion of the ground electrode to be bent and a metal material of the ground electrode are molten together by irradiation with a laser beam or electron beam on the center-electrode-side part of the portion of the ground electrode to be bent; and a nickel-based plating layer on a part of the ground electrode other than the part irradiated with the laser beam or electron beam, wherein a maximum length between a point of a surface of the plating layer closest to the molten layer and a point of the molten layer opposite from the surface of the plating layer in a thickness direction of the ground electrode is 200 μm or smaller.

2. The spark plug according to claim 1, wherein the nickel-based plating film has been applied to a part of the front end portion of the ground electrode defining the spark gap with the center electrode and been irradiated with the laser beam or electron beam so that the molten layer in which the metal material of the nickel-based plating film and the metal material of the ground electrode are molten together is formed on the part of the front end portion of the ground electrode defining the spark gap with the center electrode; and wherein the spark plug further comprises a noble metal tip joined to the molten layer.

3. The spark plug according to claim 1, wherein the nickel-based alloy of the ground electrode contains chromium; and the nickel-based plating layer contains 3 to 30 mass% of chromium.

4. The spark plug according to claim 1, wherein the nickel-based alloy of the ground electrode contains chromium; and wherein a chromate film has been applied to the nickel-based plating film to form a double coating of the nickel-based plating film and the chromate film;

wherein the molten layer in which a metal material of the double coating is molten together with the metal material of the ground electrode is formed by irradiation with the laser beam or electron beam on the center-electrode-side part of the portion of the ground electrode to be bent;

wherein the nickel-based plating layer is formed on the part of the ground electrode other than the part irradiated with the laser beam or electron beam; and wherein the spark plug further comprises a chromate film layer on the nickel-based plating layer.

5. The spark plug according to claim 4, wherein the double coating of the nickel-based plating film and the chromate film has been applied to a part of the front end portion of the ground electrode defining the spark gap with the center electrode and been irradiated with the laser beam or electron beam so that the molten layer in which the metal material of the double coating and the metal material of the ground electrode are molten together is formed on the part of the front end portion of the ground electrode defining the spark gap with the center electrode; and wherein the spark plug further comprises a noble metal tip joined to the molten layer.

6. A production process of a spark plug, the spark plug comprising: a rod-shaped center electrode extending in an axis direction of the spark plug; a cylindrical insulator having an axial hole formed therein in the axis direction and retaining the center electrode in the axial hole; a cylindrical metal shell disposed on an outer circumference of the insulator; a ground electrode made of a nickel-based alloy, extending from a front end portion of the metal shell and bent at a substantially middle portion thereof in such a manner as to define a spark gap between a front end portion of the ground electrode and a front end portion of the center electrode; and a nickel-based plating layer formed on parts of surfaces of the ground electrode and the metal shell, the production process comprising:

a plating film application step for performing a nickel plating treatment on the metal shell to which the ground electrode has been joined, thereby applying a plating film to substantially the whole of the surfaces of the metal shell and the ground electrode;

a molten layer formation step for forming a molten layer in which metal materials of the plating film and the ground electrode are molten together by irradiation of a laser beam or electron beam onto at least a center-electrode-side part of the portion of the ground electrode to be bent; and a spark gap defining step for bending the portion of the ground electrode to be bent to define the spark gap between the front end portion of the ground electrode and the front end portion of the center electrode, wherein, in the molten layer formation step, the laser beam or electron beam is irradiated in such a manner that a maximum length between a point of a surface of the plating layer closest to the molten layer and a point of the molten layer opposite from the surface of the plating layer in a thickness direction of the ground electrode is larger than or equal to a thickness of the plating layer, and wherein, in the molten layer formation step, the laser beam or electron beam is irradiated in such a manner that the maximum length between the point of the surface of the plating layer closest to the molten layer and the point of the molten layer opposite from the surface of the plating layer in the thickness direction of the ground electrode is 200 μm or smaller.

7. The production process of the spark plug according to claim 6, wherein the spark plug further comprises a noble metal tip disposed on the front end portion of the ground electrode so as to define the spark gap between the noble metal tip and the center electrode; wherein, in the molten layer formation step, the molten layer is formed by irradiation of the laser beam or electron beam on a joint part of the ground electrode to which the noble metal tip is joined; and wherein the production process further comprises joining the noble metal tip to the molten layer on the joint part of the ground electrode.

8. The production process of the spark plug according to claim 6, wherein, in the molten layer formation step, the laser beam or electron beam is irradiated in an atmosphere of an oxygen partial pressure of $10^3$ Pa or lower.

* * * * *